United States Patent [19]

Bose

[11] 4,331,532

[45] May 25, 1982

[54] METHOD FOR RECOVERING BITUMEN FROM TAR SAND

[75] Inventor: Phillip R. Bose, Pleasant Hill, Calif.

[73] Assignee: Chevron Research Company, San Francisco, Calif.

[21] Appl. No.: 25,221

[22] Filed: Mar. 29, 1979

Related U.S. Application Data

[63] Continuation-in-part of Ser. No. 973,300, Dec. 26, 1978, abandoned.

[51] Int. Cl.[3] ..... C10G 1/00

[52] U.S. Cl. ..... 208/11 LE

[58] Field of Search ..... 208/11 LE

[56] References Cited

U.S. PATENT DOCUMENTS

| | | | |
|---|---|---|---|
| 2,173,842 | 9/1939 | Horner | 208/11 LE |
| 3,075,913 | 1/1963 | Scheffel et al. | 208/11 LE |
| 3,553,099 | 1/1971 | Savage et al. | 208/11 LE |
| 3,556,981 | 1/1971 | Cymbalisty | 208/11 LE |
| 4,036,732 | 7/1977 | Irani et al. | 208/11 LE |
| 4,120,777 | 10/1978 | Globus | 208/11 LE |
| 4,139,450 | 2/1979 | Hanson et al. | 208/11 LE |

*Primary Examiner*—Delbert E. Gantz
*Assistant Examiner*—Joseph A. Boska
*Attorney, Agent, or Firm*—D. A. Newell; S. R. LaPaglia; W. D. Reese

[57] ABSTRACT

In recovering bitumen from tar sand by separation using an aqueous liquid, contamination of the aqueous phase with dispersed, finely divided solids is prevented by a mild heat treatment of the bituminous sand to reduce its water content before the sand is contacted with the aqueous liquid.

15 Claims, 2 Drawing Figures

METHOD FOR RECOVERING BITUMEN FROM TAR SAND

CROSS-REFERENCE TO RELATED APPLICATIONS

This application is a continuation-in-part of my copending application Ser. No. 973,300, filed Dec. 26, 1978 now abandoned.

BACKGROUND OF THE INVENTION

This invention relates to a method for separating bitumen from bituminous sand using an aqueous liquid. In particular, the invention concerns a method for preventing contamination of process water with finely divided solids during separation of bitumen from solids.

Bituminous sand from the Canadian Province of Alberta is made up primarily of a mixture of particulate solids, bitumen and water. Sand grains are each contained within a film of water. An envelope of bitumen surrounds the wetted grains. The interstices between sand particles contain bitumen, water, gas and a substantial amount of very finely divided inorganic solid material such as clay and silt. Clay and silt often make up as much as 10–30% of the tar sand.

Typically, separation of bitumen from particulate solids using a high-temperature, aqueous liquid involves (1) "conditioning", in which the raw bituminous sand is mixed with steam, liquid water, and usually also with surfactants and/or frothing agents, to form a pulp, and the water-sand pulp is adjusted to the desired consistency and temperature, and a slightly basic pH and screened and passed to a separation cell or zone, which contains a relatively large body of aqueous liquid; (2) "primary separation", in which the sand and other particulates settle out to the bottom of the aqueous liquid phase as a bottoms layer, the essentially water-insoluble bitumen floats on the top of the aqueous phase as a froth, the froth is separated for further processing, the sand is discharged as tailings, the aqueous liquid phase or "middlings" is split into a recycle stream, which passes back to the conditioning step, and a drag stream; (3) "scavenging", or "secondary separation", in which a further quantity of bitumen is recovered from the aqueous drag stream by air-induced froth flotation in a secondary cell, where the drag stream is collected as a relatively large body of aqueous liquid. The aqueous liquid effluent from the scavenging step is usually directly discharged from the processing system, because it is too heavily contaminated with dispersed, finely divided solids for further use. Bitumen obtained from the secondary separation step is normally mixed with that recovered in the primary separation step. Bitumen separated from the particulate, inorganic solids in the general manner described above is normally further purified and then subjected to one or more or refining operations analogous to those used for refining petroleum, such as fractionation and coking.

The conditioning step in bitumen separation usually involves heating the bituminous sand to an elevated temperature, e.g., 65°–95° C., but such heating is not for the purpose of dehydrating the sand, and typically takes place in the presence of liquid water, which is added in order to provide a pulp of the desired consistency. The heating conventionally carried out in the conditioning step is primarily to give the water-tar sand mixture, or pulp, the desired consistency, both by softening the bitumen and by decrepitating the larger lumps of tar sand. A discussion of the make-up of bituminous sand and of conventional processes for separating bitumen is included in the Synthetic Fuels Data Handbook, Thomas A. Hendrickson, Editor (1975), the complete disclosure of which is hereby incorporated in this specification.

Separation of bitumen from bituminous sand by contact with an aqueous liquid phase is not invariably carried out at higher temperatures. In the "cold-water" type separation procedures, bituminous sand is typically first mixed with a relatively lower-boiling, non-viscous bitumen solvent or diluent, such as naphtha, and this mixture is contacted with an aqueous liquid, typically at a temperature below 65° C. The mixture or solution of bitumen and solvent forms a separate, oily phase which floats on the aqueous liquid and is skimmed off the aqueous phase. The particulate inorganic materials settle to the bottom of the aqueous liquid phase.

The water used in bitumen separation in commercial aqueous-phase separation operations, such as middlings or scavenging water, rapidly becomes heavily contaminated with finely divided solids, particularly clay. When the concentration of fine solid contaminants becomes too high, the contaminated water can no longer be practicably used in the aqueous liquid separation operation, because the finely divided solids seriously retard separation of the bitumen from the aqueous liquid. The fine, solid contaminants are present in the process water as a stable dispersion, and do not settle out easily when the process water is allowed to stand without agitation. The solids-contaminated water must be segregated from ground water, both because of its solid content and also because the processing streams are often contaminated with residual bitumen. The waste water segregation requirement necessitates the use of extremely large storage ponds where the contaminated water is held for long periods of time. In commercial aqueous-phase bitumen recovery operations, storage of large amounts of solids-contaminated water presents serious economic and environmental problems. Some of the problems associated with water-solids dispersions in tar sands processing are recognized and discussed in, for example: U.S. Pat. No. 3,953,318, which suggests recycling sludge to reduce the amount of stored sludge; U.S. Pat. No. 4,008,146, which suggests mixing sand with sludge to aid in settling solids; and U.S. Pat. No. 4,018,664, which suggests mixing sludge with diluent water to reduce the settling problem.

A heating step has been included in various systems proposed for treating bituminous sand. In the "hot-water" type separation system shown in U.S. Pat. No. 4,067,796, the conditioning step involves heating bituminous sand in the presence of liquid water. Heating is used to retort and disintegrate bituminous sand in a process disclosed in U.S. Pat. No. 1,592,179, whch describes heating bituminous sand with superheated steam and a hydrocarbon gas to draw off vaporized bitumen.

SUMMARY OF THE INVENTION

In an embodiment, the present invention relates to a method for separating bitumen from a bituminous sand which includes bitumen and particulate inorganic solids, having a water content of and more than 0.1 weight percent, comprising: (a) reducing the concentration of water in the bituminous sand to a concentration less than said water content and greater than 0.01 weight percent by heat-treating the bituminous sand at a temperature between 25° C. and 100° C. in the absence of liquid water; and (b) contacting the bituminous sand with an aqueous liquid, and separating bitumen from the aqueous liquid and from the particulate inorganic solids.

I have found that the formation of stable water-solids dispersions during separation of bitumen from bituminous sand in contact with an aqueous liquid phase can be substantially prevented by a very moderate heat treatment of the bituminous sand, prior to the separation step, to reduce the water content of the tar sand. Removal of water by heat treatment according to the invention apparently converts normally hydrophilic, finely divided solids in the bituminous sand to a hydrophobic form resistant to the water-wetting necessary to form highly dispersed solids. While not wishing to be bound to any theory or mechanism of operation, it is believed that the mild heat treatment of the invention shrinks the water envelopes surrounding sand grains, and permits the dispersion-forming solids present in the water envelopes to contact hydrocarbon components in the bitumen. The dispersion-forming solids are believed to be rendered hydrophobic by contact with components of the bitumen, which substantially impedes their dispersion in the aqueous phase during aqueous separation of bitumen from the sand grains. It is believed that asphaltenes components in the bitumen may be particularly important in interacting with clay and like dispersion-forming, finely divided solids to make the solids less susceptible to dispersion formation.

BRIEF DESCRIPTION OF THE DRAWINGS

The attached drawings are schematic representations of preferred embodiments of the present invention.

Figure 1:
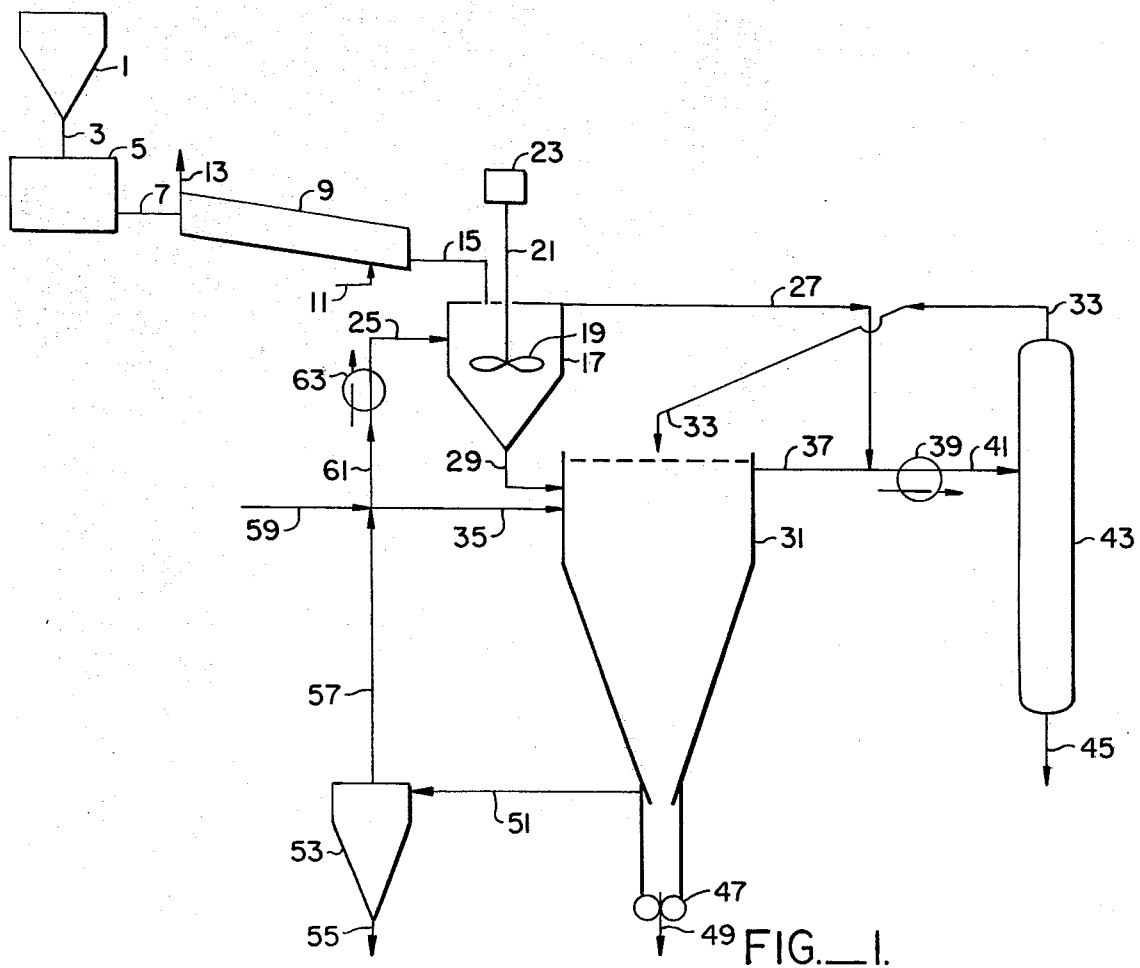
Referring to FIG. 1, there is a shown a bituminous sand separation system, in which tar sand is fed from a hopper 1 through a conduit 3 into a crusher and sizer 5. Properly sized bituminous sand is passed from the crusher through a conduit 7 into a heater-drier 9. In the drier, which is preferably in the form of a rotary kiln, most of the water contained in the tar sand is vaporized and removed from the bituminous sand by a mild heat treatment. Flue gas for heating and sweeping the bituminous sand is introduced into the heater-drier 9 through a conduit 11. Vaporized water and flue gas are withdrawn from the drier through a conduit 13. Dried bituminous sand is passed from the drier through a conduit 15 into a primary bitumen extractor 17. Impellers 19, attached to a shaft 21 which is rotated by motor means 23, provide a means for mixing the bitumen entering the extractor 17 with a hot aqueous liquid present in the extractor. Hot, make-up water to maintain the aqueous phase in the extractor is introduced via a conduit 25. Bitumen floats on the top of the body of aqueous liquid in the extractor and is removed through a conduit 27. A mixture of particulate solids, aqueous liquid and unextracted bitumen is removed from the primary extractor 17 through a conduit 29 and is passed into a secondary extractor 31. Water is introduced into the secondary extractor 31 through a conduit 35 to maintain an aqueous phase therein. A second portion of bitumen floats on the body of aqueous liquid in the extractor 31, while solids settle out to the bottom of the aqueous phase. The bitumen removed from the extractor through a conduit 37. The bitumen is removed from the primary extractor through the conduit 27 is added to the bitumen in the conduit 37. The bitumen in the conduit 37 is heated by indirect heat exchange with steam in an exchanger 39 and is then passed through a conduit 41 into a flash distillation separator 43. Water passes overhead from the separator 43 as vapor and is returned to the secondary extractor 31 through the conduit 33 after cooling and condensation by conventional means not shown. The bitumen product is removed as a liquid bottoms from the flash separator 43 through a conduit 45, and is recovered from the system. Referring again to the secondary extractor 31, a solids-water slurry high in particulate solids, such as sand and clay, is separated from the body of aqueous liquid by means such as a star feeder 47, removed from the bottom of the extractor 31 through a conduit 49 and is discharged from the operation. An aqueous stream containing water along with some finely divided solids is removed from the lower end of the extractor 31 through a conduit 51 and is passed to a centrifugal separator 53, where most of the solids are removed from the water. A solids-rich aqueous slurry is removed from the centrifugal separator 53 through a conduit 55 and is discharged from the operation. A relatively solids-free aqueous stream suitable for recycle is removed from the centrifugal separator 53 and is passed into a conduit 57. Fresh water is introduced into the operation through a conduit 59. The fresh water from the conduit 59 and the recycle water from the conduit 57 are mixed. One portion is passed into the recycle conduit 35 and the remainder is passed into a conduit 61 which leads to a heat exchanger 63. In the exchanger 63 water from the conduit 61 is heated by indirect heat exchange with steam. The heated water is then passed through the conduit 5 into the primary bitumen extractor 17.

Various conventional, necessary elements of the drying and extraction systems illustrated in the Figures and described above, such as control means, pump means, heating and cooling means, etc., are not shown in the Figures or specifically described, to simplify the description. The use and placement of such equipment and controls in embodiments of the bitumen separation systems described will be apparent to those skilled in the art.

DETAILED DESCRIPTION OF THE INVENTION

The method of the present invention is preferably employed for recovering a desired hydrocarbonaceous material from intimate admixture with particulate inorganic solids. The term "bituminous sand", as used herein, includes a variety of naturally occurring mixtures of tar, oil or bitumen with particulate inorganic solids such as sand, silica, clay, etc. The bituminous sands to which the method of the present invention is preferably applied include sands having a water content above 0.1 weight percent. Accordingly, the present invention is particularly applicable to recovering bitumen from the water-containing bituminous sands which are found in Alberta Province, Canada.

As discussed above, commercial operations for separating bitumen from Alberta bituminous sands using an aqueous liquid have been severely hampered by the necessity for handling and storing stable dispersions of finely divided solids which form in the water used in processing. By operating a bitumen separation system according to the method of the present invention, formation of such water-solids dispersions can be substantially prevented. Consequently, the large settling or tailings ponds now maintained in commercial hot-water bitumen separation operations are unnecessary.

According to the invention, the bituminous sand from which bitumen is to be removed is first heat treated to reduce the water content of the sand to a very low level, but not to dry the sand completely. The water content of the sand should be at least 0.01 weight percent after drying. Preferably, the water content of the bituminous sand is reduced to not less than 0.07 weight percent.

I have found that, when the bituminous sand is dried completely (e.g. less than 0.01 weight percent water), it is very difficult to separate the bitumen from the sand grains. It is believed that complete dehydration causes the normally hydrophylic sand grains to contact hydrocarbon components of the bitumen and become hydrophobic. Thus, it is highly desirable to remove most, but not all, of the water content of the bituminous sand. Good results have been obtained when the tar sand has been dried to a residual water content of about 0.02 weight percent or more, and particularly good results have been obtained when drying to a 0.07 weight percent or higher residual water content.

When treating tar sands which have an original water content which is quite low, e.g., 0.1 weight percent or below, little or no benefit from the heat treatment of the invention can be observed. Accordingly, the present process is particularly useful for treating tar sands having original water contents of greater than 0.1 weight percent, and especially those having original water contents of 1.0 weight percent or more.

It is contemplated that the heating, dehydration treatment will be performed in a manner sufficiently effective to remove a substantial portion of the original water concentration of the tar sand, e.g. to remove at least 10 weight percent of the original water content; however, some benefit may be obtained by heat treating, even when less than 10 percent of the original water content is removed. Preferably, enough water is removed to reduce the final water concentration in the tar sand to 0.5 weight percent, or less, and a reduction to below 0.25 weight percent is particularly preferred. The heat treatment should be carried out at a temperature sufficient to soften the bitumen in the tar sand. The lowest effective temperature may vary, depending on the composition of the bitumen in a given tar sand sample. Good results are usually obtained when the dehydration-heat treatment is carried out at a temperature of 25°–100° C. Preferably, the heat treatment for substantial dehydration of the sand is carried out at a temperature between 27°–50° C. I have found that substantial dehydration of tar sand using mild heat treatment is superior to high-temperature dehydration treatment. The period of time for which the heat treatment of the sand according to the invention is carried out is, in general, a time sufficient to substantially reduce the water content of the bituminous sand at the temperature employed. Usually, good results are obtained when at least 10 weight percent of the water content is removed. Preferably, the period of heating is maintained in the range from 5–60 minutes, for example by adjusting the heating temperature to the particular type of sand being treated. In general, higher temperatures provide more rapid dehydration. It will be understood that a relatively longer heat treatment may be required for sands having a relatively higher water content.

The pressure utilized in the heat treating step is not critical. Lower pressures will generally facilitate dehydration of the bituminous sand, but pressures from subatmospheric to 20 atmospheres or more are suitable. For example, vacuum drying may be useful. I prefer to operate at about atmospheric pressure since this is a safe pressure, as well as being convenient and economical. The bituminous sand can be dried much more rapidly and efficiently if the sand is swept by a non-reactive gas during the heating. Heat may be supplied to the sand wholly or in part by a hot gas. Passing a gas stream in contact with the sand provides a convenient medium for removing water vapor from contact with the sand after it has evolved. Essentially non-reactive sweeping gases include, for example, nitrogen, flue gas or stack gas, carbon dioxide, etc. In many cases, air is suitable; however, an inert gas, such as nitrogen, appears to give somewhat better results.

The heating means which are used for heating the bituminous sand may be of conventional type. As stated, a heat-carrying, non-reactive gas such as flue gas or nitrogen is preferably used to heat the sand sweep water vapor away from the sand, although heat energy can alternatively or additionally be applied by indirect heating or any other conventional means.

Preferably, some means for stirring, mixing or agitating the sand is included in the heating system. I have found that subjecting the tar sand to agitation, such as mixing, stirring or grinding during the heating-dehydration treatment, seems to increase the effectiveness of the heating procedure. Better separation of bitumen and more effective inhibition of solids-water dispersions appears to be obtained at heating conditions otherwise the same, when agitation accompanies the drying operation. Preferably, the agitation is of the type carried out in using a rotary kiln for drying the tar sand. Of course, the mixing or stirring also provides more effective contact between the tar sand and a sweeping gas. This may explain at least part of the observed improvement. The heat treating can be carried out in a batch-type system or in a continuous-type system. For example bituminous sand can be continuously conveyed through the heating zone using an auger, a helical conveyor, a conveyor belt, or the like. Optionally, a charge of sand can be introduced into a heating zone, dried and removed as a batch. Continuous-type systems are preferred for convenience of operation. The suitability of various types of apparatus such as rotary driers, kilns, etc., for use to provide a zone for carrying out the heating, will be apparent to those skilled in the art. Any convenient vessel can be employed, since the heating conditions are relatively mild.

The heating-dehydration treatment is employed in conjunction with the use of an aqueous liquid to effect separation of bitumen from particulate solids. Accordingly, after the heating step is completed, bitumen is separated from particulate solids by contacting the dehydrated bituminous sand with an aqueous liquid. The aqueous separation step (or series of steps) is performed at a separation temperature of about 10° C. to about 100° C., or more. Higher temperatures can be used only in conjunction with elevated pressures, since water is used in the liquid phase. Temperatures below about 66° C. are usually practicable only when a viscosity-reducing and/or density-reducing diluent or solvent such as naphtha is employed. Such bitumen diluents are further discussed below. Preferably, unless a diluent is used, the aqueous liquid is maintained at a temperature between about 66° C. and 95° C. Conveniently, atmospheric pressure can be used, but the pressure during the aqueous separation step is not critical aside from assuring maintenance of a liquid aqueous phase.

When the bituminous sand is contacted with a body of aqueous liquid, bitumen separates and floats on top of the aqueous phase. The bitumen is then recovered by skimming, decantation, or like physical separation. Inorganic particulate material, such as clay and sand, tends to settle to the bottom of the aqueous phase. Some heavier bitumen may also be entrained with the inorganic solids, especially with finely divided silt and clays, which generally form a separate layer above the grains of relatively coarse sand. In cases where a substantial fraction of bitumen remains associated with the inorganic solids after contact with aqueous liquid, and flotation and separation of a first part of the bitumen, it is often desirable to subject the remaining mixture of bitumen and inorganic solids to a second aqueous separation step. Such a second separation step may be performed under the same separation conditions as the first separation step or at separation conditions partially different from those used in the first separation stage. For example, the temperature of the aqueous liquid in a second separation stage may be higher, or a light hydrocarbon solvent or diluent may be mixed in with the bitumen and solids in carrying out the second stage to reduce the density and viscosity of the remaining bitumen, allowing more efficient separation of the remaining bitumen from the particulate solids.

The ratio of bituminous sand to aqueous liquid in the separation stages is not particularly critical, as long as the concentration of bituminous sand is low enough to allow efficient separation of bitumen. Generally, good results are obtained when the bituminous and and aqueous liquid are mixed in a weight ratio of bituminous sand to water within the range from about 1 to about 20. Preferably, a bituminous sands/water weight ratio between 1 and 10 is used. The liquid aqueous phase may simply be liquid water, or may contain one or more salts, surfactants or the like, which are useful in some cases to facilitate rapid and complete bitumen separation. For example, a dilute solution of sodium hydroxide in water can often be advantageously employed.

The bituminous sand and water contacted in a separation zone which can be any convenient container or vessel adapted for holding the mixture of bituminous sand and aqueous liquid. The separation zone may optionally be provided with stirring means to aid in dispersing and decrepitating the bituminous sands when it contacts the water. In other embodiments, the bituminous sand may be mixed with water to form a slurry or pulp, with the slurry then being contacted with a larger body of aqueous liquid. Stirring, if used either to form a slurry or to decrepitate sand in contact with the aqueous liquid, must be performed cautiously, since too great a degree of agitation tends to disperse finely divided solids in the aqueous phase, contrary to a primary object of the present invention. Usually, just enough stirring to decrepitate the sand fully is preferred. If too great a degree of agitation is used, the water must be continually replaced because it does not permit efficient separation of the bitumen.

The separation of bitumen from the aqueous phase and from particulate inorganic solids may optionally be carried out in the presence of a diluent, or solvent, in which the bitumen is fully or partially soluble. Such a diluent may be useful for reducing the viscosity and/or the density of the bitumen. This is especially useful in operating at lower temperatures, e.g., below 82° C., and especially below 66° C. Preferred diluents are hydrocarbons or mixtures of hydrocarbons having normal boiling points within the range from 25° C. to 220° C. Mixtures of hydrocarbons having a boiling range within the conventional naphtha boiling range are preferred diluents. Hydrocarbons or mixtures of hydrocarbons having normal boiling points of less than 120° C. are particularly preferred in carrying out the invention. Diluents are used in the amount necessary to effect the desired change in the viscosity or density of the bitument, or to dissolve the bitumen to the desired degree. The amount of the preferred diluents, lower-boiling naphthas, can vary, depending upon whether the separation is performed in a single stage or in plural stages of separation. In cases using plural-stage separation, the diluent can be used in any one or more of the stages. For example, in a two-stage separation, a first stage using simply an aqueous phase separation and a second stage using a naphtha diluent in addition to an aqueous phase, gives excellent results. Alternatively, the naphtha diluent can be employed in the first stage only. The diluent is used in the liquid phase, so that the temperature and pressure of the separation operation must be coordinated with the composition and boiling point or boiling range of the diluent to ensure that the bitumen diluent does not freeze or vaporize in undue amounts during the separation operation.

In one preferred two-stage bitumen separation procedure in accordance with the invention, after the heat treatment step has been completed the bitumen is first contacted with liquid water in the substantial absence of a diluent in a first separation zone at relatively high temperature of at least 70° C., preferably from 80° C. to 100° C., and a first portion of the bitumen in the bituminous sand is separated in the first stage from the water and particulate solids. After separating the first portion of bitumen, the particulate solids are still associated with a second portion of bitumen. Usually, the first portion of bitumen separated in the first stage includes about 20 weight percent of the total bitumen content of the original bituminous sand. After separation of a first portion of bitumen, inorganic solids and the remainder of the bitumen are then contacted with liquid water and with a liquid bitumen diluent-solvent in a second separation zone at a temperature of at least 10° C., preferably from 25° C. to 65° C. The preferred diluent for use in such an operation is least one hydrocarbon boiling in the range from 25° C. to 220° C., especially preferably from 25° C. to 160° C., e.g., a light naphtha fraction. A mixture containing a second portion of the bitumen and the naphtha diluent is separated from the particulate inorganic materials and from the aqueous phase in the second separation step.

After the bitumen has been separated from the aqueous phase and from the particulate inorganic matter, any diluent materials and/or residual water can be separated from the bitumen to permit reuse of the diluent or water and also to purify the bitumen. Such separation can easily and conveniently be performed by conventional fractionation. The bitumen can then be used as desired, e.g., as a fuel, or can be further processed and refined by such conventional operations as coking, catalytic cracking, hydrocracking, etc.

The following illustrative embodiments describe preferred modes for carrying out the method of the invention in a single-stage separation operation and in a plural-stage separation operation.

ILLUSTRATIVE EMBODIMENT I

A system like that shown in FIG. 1 is employed. Fresh bituminous sand containing 12.0 weight percent bitumen, 2 weight percent water and particulate inorganic solids including 3 weight percent clay, is passed from the hopper 1 through the conduit 3 into the sizer 5 and after sizing is passed through the conduit 7 into the drier 9 at the rate of 907.2 kg/hour. The bituminous sand is passed continuously through the drier 9, where it is maintained at a temperature of 38° C. for 17 minutes, to reduce the water content of the bituminous sand 0.10 weight percent. The heat treated bituminous sand is passed into the first-stage aqueous separator 17, where it is mixed with a body of aqueous liquid at a temperature of 88° C. with just enough stirring to decrepitate the sand. Water is introduced into the separator at the rate of 4500 kg/hour at a temperature of 88° C. A first portion of bitumen separates and floats on the aqueous phase in the aqueous separator 17. This first portion of bitumen is skimmed off and withdrawn from the separator at the rate of about 22 kg/hour through the conduit 27. A slurry of about 885 kg/hour of particulate solids, with which a second portion of the bitumen is still associated, is passed as a slurry in 4500 kg/hour of water through the bottom of the extractor 17 and into the second-stage aqueous separator 31, which contains a body of aqueous liquid maintained at a temperature of 33° C. A second portion of bitumen forms a phase floating on the aqueous liquid in the separator 31 and is removed through the conduit 37 at the rate of 86 kg/hour. A slurry of 751 kg/hour of particulate inorganic solids in 173 kg/hour water is removed from the bottom of the aqueous phase in the separator 31 through the conduit 49 and is discharged from the operation. Water for recycling to the first separation stage is withdrawn from the aqueous separator 31 at the rate of 8827 kg/hour along with 25.4 kg/hour of finely divided solids. The clay-containing water is passed through the conduit 31 into the centrifugal separator 53. Finely divided solids are removed from the centrifugal separator at the rate of 25.4 kg/hour through the conduit 55 and are discharged from the system. Fresh water is introduced into the operation at the rate of 180 kg/hour through the conduit 59, and the mixture of fresh and recycled water is passed through the conduit 61 and the conduit 35 for use in the first-stage aqueous separator. Referring to the flash separator 43, 0.2 kg/hour of water is withdrawn overhead from the separator through the conduit 33 and returned to the separator 31 after condensation. Bitumen is removed from the flash separator 43 through the conduit 45 at the rate of 112 kg/hour, and is recovered as the product of the process.

ILLUSTRATIVE EMBODIMENT II

Figure 2:
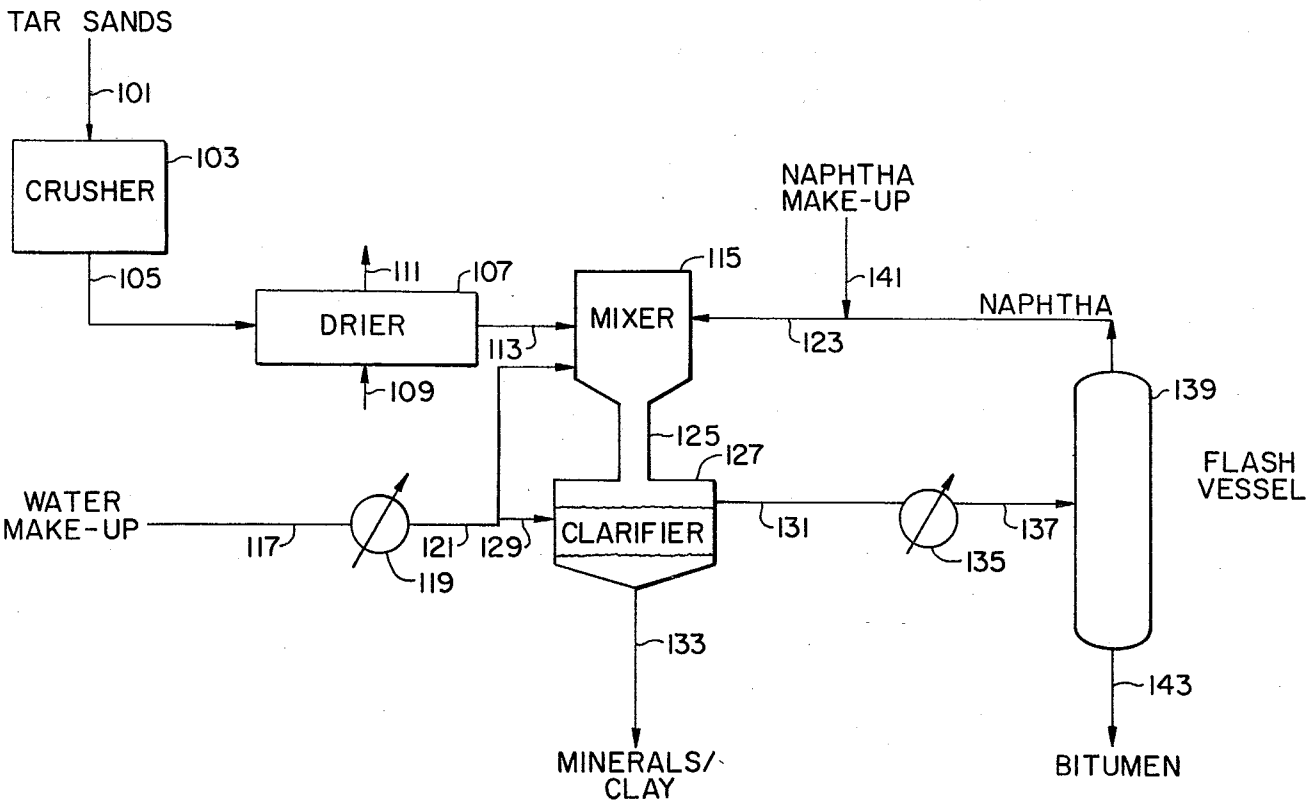
Referring to FIG. 2, there is shown a hot-water extraction system wherein bituminous sand is introduced through a conduit 101 into a crushing-sizing zone 103. Properly sized bituminous sand is passed from the crusher through a conduit 105 into a drier 107. In the drier, which may be a rotary kiln or an elongated vessel with one or more helical conveying means rotatably mounted to mix and convey the tar sand through the vessel, while the tar sand is heated by indirect heat exchange, most of the water content is removed from the bituminous sand by heat treatment with gas which is introduced through a conduit 109. Exhaust flue gas and water vapor evolved from the sand are discharged from the drier 107 through a conduit 111. Relatively dry bituminous sand is passed from the drier through a conduit 113 into a mixing vessel 115, which employs conventional mixing means not shown. Make-up water for use in the separation is introduced into the extraction system through a conduit 117 and is heated in an exchanger 119. Heated water is passed through a conduit 121 into the mixer 115. Naphtha from a conduit 123 is also introduced into the mixer as a diluent for bitumen. The dried bituminous sand, naphtha and hot water are mixed and passed from the mixer 115 through a conduit 125 into a settler-clarifier 127. The clarifier 127 contains a body of aqueous liquid. Heated make-up water for maintaining the aqueous phase is introduced into the clarifier from the conduit 121 through a conduit 129. In the clarifier, bitumen and naphtha form a phase on top of the aqueous liquid, and are removed from the clarifier through a conduit 136. Inorganic particulate matter, including sand and clay, settles to the bottom of the aqueous phase in the clarifier. The particulate inorganic solids are removed from the clarifier as a concentrated slurry in water by way of a conduit 133. The slurry is discharged from the operation as tailings. Referring again to the stream of separated bitumen in the conduit 131, the bitumen is introduced into a heating means 135. After heating, the bitumen is passed through a conduit 137 into a flash distillation separator 139. Naphtha and any water and other low-boiling materials present in the bitumen stream are vaporized and withdrawn overhead from the separator 139 through the conduit 123. The materials in conduit 123 are cooled and condensed by conventional means, not shown, and are returned to the mixer 115 for further use as descrbed above. Fresh, makeup naphtha is introduced into the conduit 119, as needed, through a conduit 141. Referring again to the flash separator 139, liquid bitumen is removed from the bottom of the separator through a conduit 143 and is recovered as a product of the operation.

A system like that shown in FIG. 2 is employed. Bituminous sand containing 2 weight percent water is introduced to the crusher 103 at the rate of 127,092 metric tons per day. The bituminous sand is dried for a residence time of 17 minutes at a temperature of 38° C. in the drier. Water vapor evolved from the bituminous sand is withdrawn through the conduit 111 at the rate of 1816 metric tons per day. The dried bituminous sand is passed through the mixer 115 at the rate of 124,550 metric tons/day. In the mixer the bituminous sand is contacted with a stream of aqueous liquid at a temperature of 82° C. The amount of water is sufficient to form a slurry. Naphtha is introduced from the conduit 123 at the rate of 4539 metric tons per day and is mixed with the bituminous sand to dilute it and reduce its viscosity and density. Make-up water is introduced into the operation from the conduit 17 at the rate 4993 metric tons/day and is heated in the heating means 119 to a temperature of 82° C. A portion of the water is passed through the conduit 121 into the mixer at the rate of 962 metric tons/day. The mixture of water, naphtha and bituminous sand is passed into the clarifier 127 at a temperature of 82° C. Make-up water is introduced into the clarifier from the conduit 121 through a conduit 129 at the rate of 4031 metric tons/day. Bitumen and naphtha form a mixture which separates as a layer above the aqueous liquid phase in the clarifier. The mixture of bitumen and naphtha is decanted and removed through the conduit 121 at aqueous liquid phase in the clarifier. The mixture of bitumen and naphtha is decanted and removed through the conduit 121 at the rate of 14,310 cubic meters/day of bitumen and 4130 metric tons/day of naphtha. The mixture of bitumen and naphtha is heated in the heating means 135 and is subjected to flash separation in the flash separator 139 at a temperature of 168§C. and a pressure of 1.16 atmospheres. Naphtha and any residual water in the bitumen are removed overhead at the rate of 4130 metric tons/day of naphtha through the conduit 123. Make-up naphtha is introduced into the conduit 123 from the conduit 141 at the rate of 412 metric tons/day. Bitumen is removed as the bottoms product from the flash separator 139 and is recovered through the conduit 143 at the rate of 14,040 cubic meters/day as the product of the process. Referring to the clarifier 127, a slurry of particulate inorganic solids in 4993 metric tons/day of water contaminated with a minor amount of naphtha and not more than 1 weight percent of the bitumen in the original feed bituminous sand, is removed from the clarifier and is discharged through the conduit 133.

EXAMPLE I

A sample of Athabasca bituminous sand was heated at a temperature of 93° C. for a period of 30 minutes in order to reduce the water content to about 0.05 weight percent. The resulting dry bituminous sand was then subjected to aqueous separation by contacting it with hot water in a beaker at atmospheric pressure with slight stirring. Bitumen formed a layer at the top of the water phase in the beaker. Clean sand formed a bottom layer below the water in the beaker. A dark solid layer formed between the sand and the aqueous layer. The dark solid layer was analyzed and found to contain clay contaminated with a minor amount of bitumen. The water layer was observed to be completely clear and free from any emulsified or dispersed finely divided solids such as clay.

EXAMPLE II

Samples of Alberta tar sand were dried in a rotary kiln at low temperatures. The residence times varied from 10 minutes to 26 minutes. The heat treating temperatures varied from 26.7° C. to about 120° C. In some tests, air was used as a sweeping gas. In other tests, a synthetic flue gas was used as a sweeping gas. The feed tar sand contained 1.6 weight percent water as determined by the ASTM-D95 (water by distillation) method. The tar sand was fed to the rotary kiln at the rate of 600 grams per hour. The residual water content of each sample was determined after drying, and the samples were subjected to hot water bitumen separation. In the separation tests, about 5 grams of a dried sample were placed in a beaker, contacted with hot water, and stirred. The ease of bitumen separation and the clarity of the water after stirring were noted. The results of tests are shown in the following Table.

TABLE

| DRYING AND HOT WATER SEPARATION | | | | | | |
|---|---|---|---|---|---|---|
| | Drying Conditions | | | | Water Separation Results | |
| Trial No. | Sweep Gas | Temp. (C.°) | Time | Wt % $H_2O$ (in dried sand) | Bitumen Separation | Water Clarity |
| 1 | Air | 26.7 | 10–15 | 0.37 | Excellent | Slight Haze |
| 2 | Air | 26.7 | 17–26 | 0.43 | Excellent | Clear |
| 3 | Air | 31.1 | 10–15 | 0.22 | Excellent | Clear |
| 4 | Flue Gas | 31.7 | 17–26 | 0.15 | Excellent | Slight Haze |
| 5 | Air | 42 | 10–15 | 0.12 | Excellent | Clear |
| 6 | Flue Gas | 42 | 17–26 | 0.07 | Excellent | Clear |
| 7 | Air | 43 | 17–26 | 0.02 | Excellent | Slight Haze |
| 8 | Air | 46.6 | 10–15 | 0.05 | Average | Clear |
| 9 | Air | 54.6 | 10–15 | 0.01 | Average | Clear |
| 10 | Flue Gas | 60.6 | 17–26 | 0.07 | Average | Clear |
| 11 | Air | 71 | 10–15 | 0.01 | Below Average | Clear |
| 12 | Air | 81 | 17–26 | none | Below Average | Clear |
| 13 | Air | 119.5 | 17–26 | none | None | Clear |

The results shown in the Table demonstrate that the present invention effectively inhibits formation of water-solids dispersions, while permitting effective hot water separation of bitumen.

Preferred embodiments and aspects of the present invention having been described, numerous modifications, equivalents and adaptations of the present invention will be apparent to those skilled in the art. Such modifications, equivalents and adaptations are intended to be included within the scope of the appended claims.

What is claimed is:

1. A method for separating bitumen from a bituminous sand, said bituminous sand including bitumen and particulate inorganic solids, and having a water content of more than 0.1 weight percent, comprising:

(a) reducing the concentration of water in said bituminous sand to a concentration less than said water content and greater than 0.01 weight percent by heat treating said bituminous sand at a temperature between 25° C. and 100° C. in the absence of liquid water; and (b) contacting the resulting dried bituminous sand with an aqueous liquid, and separating bitumen from the aqueous liquid and from said particulate inorganic solids.

2. A method according to claim 1 wherein said aqueous liquid is maintained at a temperature between 66° C. and 100° C.

3. A method according to claim 1 wherein said heat treating is carried out for a period of 5 to 60 minutes.

4. A method according to claim 1 wherein the concentration of water in said bituminous sand is reduced to not less then 0.07 weight percent by said heat treating.

5. A method according to claim 1 wherein said heat treating is carried out at a temperature between 27° C. and 50° C.

6. A method according to claim 1 wherein said resulting dried bituminous sand is contacted with said aqueous liquid in the presence of at least one liquid-phase hydrocarbon having a normal boiling point within the range from 25° C. to 220° C.

7. A method according to claim 6 wherein at least a portion of said hydrocarbon is separated from said aqueous liquid and from said particulate inorganic solids in admixture with said bitumen.

8. A method according to claim 1 wherein said bituminous sand is subjected to agitation during said heat treating.

9. A method according to claim 1 wherein the concentration of water in said bituminous sand is reduced to a level of not less than 0.07 weight percent.

10. A method for separating bitumen from a bituminous sand, said bituminous sand including bitumen and particulate inorganic solids, and having a water content of more than 0.1 weight percent, comprising:

(a) reducing the concentration of water in said bituminous sand to a concentration less than said water content and greater than 0.01 weight percent by heat treating said bituminous sand at a temperature between 25° C. and 100° C. in the absence of liquid water;

(b) contacting the resulting dried bituminous sand with liquid water in a first separation zone at a temperature of at least 70° C., and separating a first portion of bitumen from said particulate inorganic solids, said particulate inorganic solids having a second portion of bitumen remaining associated therewith; and (c) contacting said particulate inorganic solids with liquid water in a second separation zone at a temperature of at least 10° C., and separating said second portion of bitumen from said particulate inorganic solids.

11. A method according to claim 10 wherein the temperature in said first separation zone is maintained in the range from 80° C. to 100° C.

12. A method according to claim 9 wherein the temperature in said second separation zone is maintained in the range from 25° C. to 65° C.

13. A method according to claim 10 wherein said particulate inorganic solids are contacted with liquid water in said second separation zone in the presence of at least one hydrocarbon having a normal boiling point within the range from 25° C. to 220° C.

14. A method according to claim 10 wherein said bituminous sand is subjected to agitation during said heat treating.

15. A method according to claim 10 wherein the concentration of water in said bituminous sand is reduced to a level of not less than 0.07 weight percent.

* * * * *